United States Patent [19]

Young et al.

[11] Patent Number: 4,534,080

[45] Date of Patent: Aug. 13, 1985

[54] CHIMNEY CLEANING TOOL

[76] Inventors: Robert S. Young, Rte. 1, Box 827, Pelzer, S.C. 29669; Wilton Leopard, Rte. 8, Box 196, Piedmont, S.C. 29673

[21] Appl. No.: 574,848

[22] Filed: Jan. 30, 1984

[51] Int. Cl.[3] ..... F23J 3/02; A46B 13/02

[52] U.S. Cl. ..... 15/23; 15/104.1 R; 15/162; 15/179; 15/198

[58] Field of Search ..... 15/23, 159 A, 104.14, 15/179–182, 200, 162, 55, 197, 198, 104.1 R, 104.1 C, 163

[56] References Cited

U.S. PATENT DOCUMENTS

| | | | |
|---|---|---|---|
| 1,338,917 | 5/1920 | Hall | 15/179 |
| 1,663,194 | 3/1928 | Denman | 15/200 |
| 2,072,110 | 3/1937 | Jennings | 15/198 X |
| 2,676,447 | 4/1954 | Asbury | 15/198 X |
| 3,278,966 | 10/1966 | Godfrey | 15/198 |
| 3,381,754 | 5/1968 | Tompkins | 15/104.14 |
| 3,583,020 | 6/1971 | Bateman | 15/198 |

FOREIGN PATENT DOCUMENTS

| | | | |
|---|---|---|---|
| 1165378 | 10/1958 | France | 15/200 |
| 2355479 | 6/1976 | France | 15/200 |
| 834598 | 5/1960 | United Kingdom | 15/179 |

*Primary Examiner*—Edward L. Roberts
*Attorney, Agent, or Firm*—Dority & Manning

[57] ABSTRACT

A chimney cleaning tool which is adapted to be inserted on the end of a power driven motor such as an electric drill. The tool has an attachment device carried on a remote end of an elongated shaft. Elongated multi-strand steel twisted cables extend outwardly from the attachment device. The outer ends of the twisted cables are circumferentially spaced from each other and are free to untwist to form a plurality of brush-like heads for cleaning chimneys and the like. A restricting member is carried on each of the multistrand twisted cables intermediate the outer and inner ends, limiting the extent that the cables can untwist from the outer ends inwardly towards the inner ends.

4 Claims, 3 Drawing Figures

CHIMNEY CLEANING TOOL

BACKGROUND OF THE INVENTION

In fireplaces wherein wood is burned it is important that the chimney and the flue extending through the chimney be cleaned periodically to prevent the buildup of resin and soot within the chimney. If the chimney is not properly cleaned, after a period of time the buildup of resin becomes a fire hazard and can cause a fire within the chimney itself. Heretofore, chimney sweepers have normally gone up on the roof of the building and used elongated brushes for sweeping out the vertically extending top portion of the chimney. After they have cleaned the vertically extending top portion of the chimney, it is necessary to come down within the house and clean the lower portion of the chimney. Most chimneys have a shelf directly over the bed of the fireplace upon which the fire is set. As a result, there is considerable buildup of resin and soot on the shelf and the portion of the chimney directly above the fire. The back portion of the shelf is difficult to reach by hand and chimney cleaners are normally required to use a hand-held brush and reach back into the chimney to scrape the resin and buildup therefrom. Such is a time consuming and tedious job. As a result, very often the shelf portion is not fully cleaned.

SUMMARY OF THE INVENTION

In accordance with the present invention, a chimney cleaning tool is provided which is adapted to be attached to the end of an electric motor. This electric motor can be the motor of a power driven drill which has a chuck thereon. The tool has an elongated shaft and one end is inserted within the chuck of the drill. Positioned on the remote end of the elongated shaft is an attachment device. Elongated multistrand twisted steel cables are carried by the attachment device. These elongated multistrand steel cables extend radially outwardly from the attachment device and are circumferentially spaced therearound. The outer ends of the multistrand twisted cables are free to untwist to form a plurality of brush-like heads. The ends can be untwisted manually before the cleaning operation or upon striking a surface during the cleaning of the chimney they automatically become untwisted as a result of the frictional contact between the ends thereof and the wall of the chimney.

In order to prevent the cables from untwisting along their entire length, restricting members are carried on the multistrand twisted cable intermediate the outer ends and inner ends. Such restricts the extent that the cables untwist when they engage the chimney.

The inner ends of the multistrand cables are inserted within radially extending slots provided on the attachment device and are removably secured therein by set screws. As a result, the multistrand cables can be readily removed from the attachment device and cables of different lengths can be inserted therein for producing cleaning heads of different lengths.

Accordingly, it is an important object of the present invention to provide a chimney cleaning tool that is relatively simple to construct and very effective for cleaning hard to remove resins and soot buildup from chimneys.

Another important object of the present invention is to provide a chimney cleaning tool wherein the radially extending brush-like members carried on the head can be readily changed for reaching into chimneys of different sizes.

Still another important object of the present invention is to provide a chimney cleaning tool that can be readily inserted within the chuck of a power drill so that the person operating the device can clean the inside of a chimney by merely inserting the end upon which the multistrand cables are carried up in the chimney.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
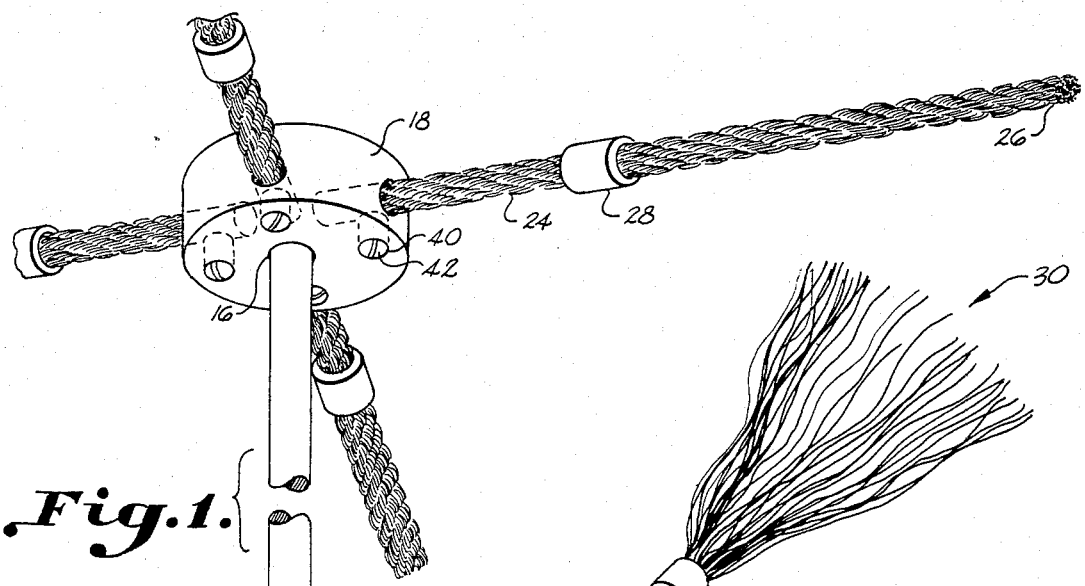
FIG. 1 is a perspective view illustrating a portion of a chimney cleaning tool constructed in accordance with the present invention.

In FIG. 1 there is illustrated a chimney cleaning tool which has an elongated shaft 10 constructed of any suitable material such as a steel rod. The lower end of the shaft 10 is adapted to fit within a chuck 12 of a conventional power drill 14. The upper end of the elongated shaft is inserted within a bore 16 carried within an attachment device 18. In one particular embodiment, the upper end of the elongated shaft is secured within the bore 16 by welding.

The attachment device 18 is in the form of a steel disk and has a plurality of radially extending slots 22 provided therein. These slots are provided for receiving the inner ends of a plurality of multistrand twisted steel cables 24. In one particular embodiment, the multistrand steel cables includes seven bundles of strands with each bundle including nineteen strands. As a result, there are a one hundred and thirty-three steel strands in the cable. The steel cable in one particular embodiment has a diameter of approximately one-fourth of an inch.

Figure 2:
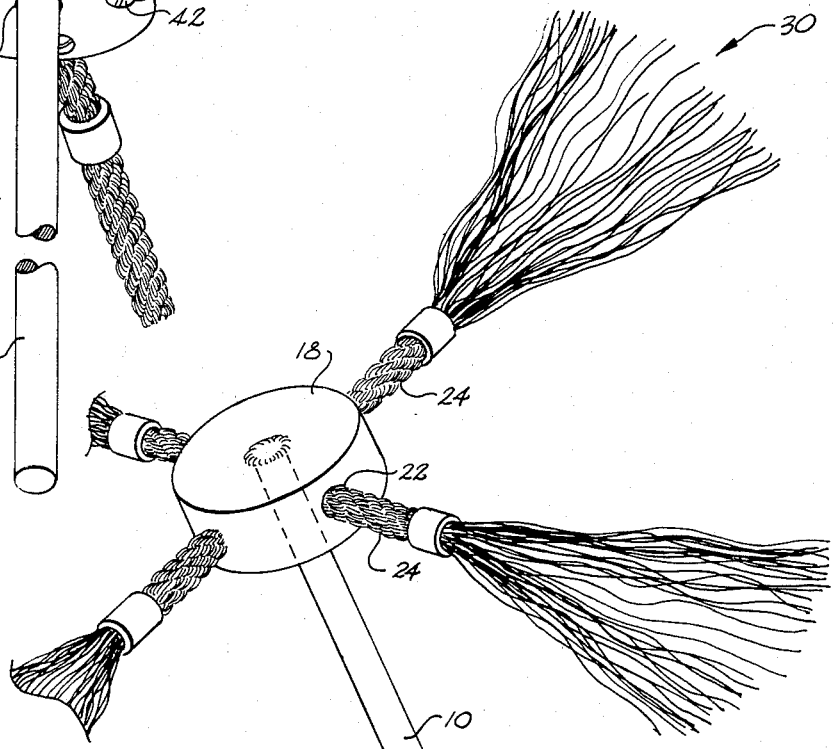
FIG. 2 is in enlarged perspective view illustrating a portion of a chimney cleaning tool after the multistrand cables forming part of the tool have been untwisted.

The twisted steel cable can be of any suitable length depending upon the particular application that the cleaning device is being used for. Positioned between the inner and outer ends 26 of the steel cable is a restricting member 28 which is in the form of a steel sleeve. This sleeve 28 is fixed to the cable by crimping. As a result of the restricting sleeve 28, the multistrand cable 24 is prevented from untwisting beyond that point when the tool is being used to clean a chimney. This produces a bushy-type brush head generally designated by the reference character 30, such as shown in FIG. 2.

Normally, when the multistrand cables 24 are initially inserted within the attaching device, the cable is in a twisted condition such as shown in FIG. 1. However, immediately upon using the tool to clean a chimney, the frictional contact between the walls of the chimney and the cables unravels the remote ends of the cables to produce a brush-like head.

Since the cable is made of steel, the brush-like head is a very effective mechanism for removing hard to remove resins from the inside of a chimney.

Figure 3:
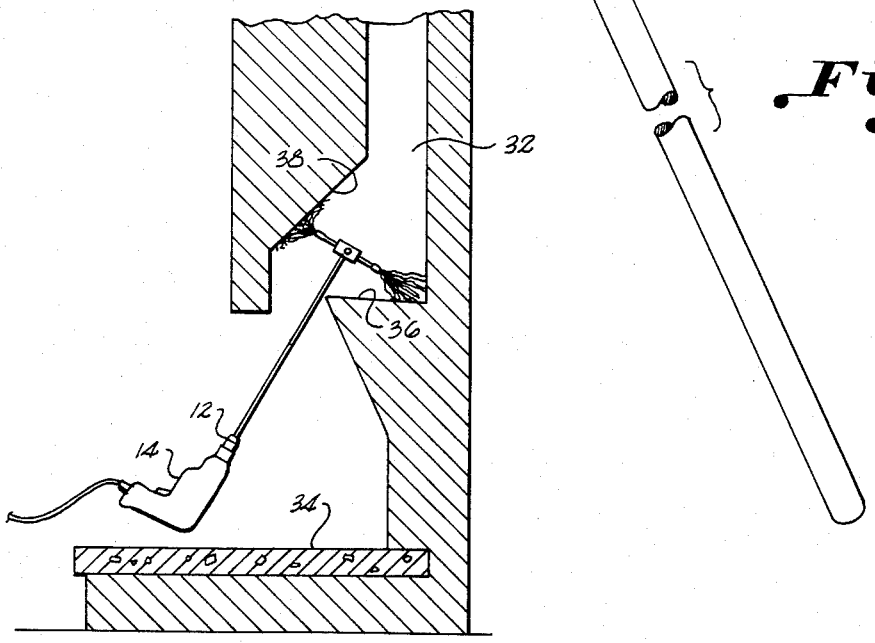
FIG. 3 is a side elevational view illustrating the chimney cleaning tool being used to clean a chimney.

As shown in FIG. 3 in schematic form, located above the bed 34 of a fireplace is a horizontal shelf 36. As the chimney is used for burning wood and the like, resin builds up on the shelf 36 and on the inclined wall 38 of the chimney. Of course, there is a certain amount of buildup of resin and soot all throughout the chimney. However, the back side of the shelf 36 is normally the most difficult area of the chimney to clean. When the tool is being used for cleaning the chimney, the power drill 14 is held at an angle such as shown in FIG. 3, so that the ends of the steel cable 24 will reach into the corners and remote portions of the chimney, particularly above the shelf 36. As a result of the rotating action of the tool with the brush-like ends 30 striking the walls of the chimney, the resin and soot buildup is readily removed. Since the cables 24 are multistrand steel cables, the brushing action is extremely effective with a minimum wear of the brush-like ends of the cleaning tool. In order to change the cables 24 when it is desired to use cables of different lengths, it is only necessary to loosen set screws 40 extending within the bores 42 carried within the attachment device 18. The upper ends of the set screw 40 lock the inner ends of the cable within the radially extending bores provided in the attachment device.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A chimney cleaning tool, a power driven motor attached to said chimney cleaning tool rotating said tool, said chimney cleaning tool comprising:

an elongated shaft, one end of said shaft being connected to said power driven motor;

an attachment device carried adjacent the other end of said elongated shaft;

elongated multistrand twisted cables having inner ends thereof being connected to said attachment device and outer ends being radially spaced from said attachment;

said outer ends of said twisted cables being circumferentially spaced from each other;

restricting members carried on said multistrand twisted cable intermediate said outer and inner ends; and said outer ends of said multistrand twisted cables being free to untwist inwardly to the position of said restricting members to form a plurality of brush-like heads capable of cleaning chimneys and the like.

2. The chimney cleaning tool as set forth in claim 1 further comprising:

said restricting members being bands fixed to said elongated twisted cables intermediate said inner and outer ends.

3. The chimney cleaning tool as set forth in claim 1 further comprising:

said attachment device having;

(i) circumferentially spaced radially extending slots provided therein, (ii) said inner ends of said multistrand twisted cables being carried within a respective slot in said attachment device, and (iii) set screw means for removably securing said inner ends of said twisted cables in said slots.

4. The chimney cleaning tool as set forth in claim 1 further comprising:

said elongated multistrand twisted cables being multistrand twisted steel cables.

* * * * *